US005214417A

United States Patent [19]

Yamazaki

[11] Patent Number: 5,214,417

[45] Date of Patent: * May 25, 1993

[54] LIQUID CRYSTAL DISPLAY DEVICE

[75] Inventor: Katsunori Yamazaki, Suwa, Japan

[73] Assignee: Seiko Epson Corporation, Tokyo, Japan

[ * ] Notice: The portion of the term of this patent subsequent to Apr. 23, 2008 has been disclaimed.

[21] Appl. No.: 621,206

[22] Filed: Dec. 3, 1990

Related U.S. Application Data

[63] Continuation-in-part of Ser. No. 232,750, Aug. 18, 1988.

[30] Foreign Application Priority Data

| | | | |
|---|---|---|---|
| Aug. 13, 1987 | [JP] | Japan | 62-202154 |
| Feb. 9, 1988 | [JP] | Japan | 63-27922 |
| Feb. 9, 1988 | [JP] | Japan | 63-27923 |
| Feb. 9, 1988 | [JP] | Japan | 63-27924 |
| Dec. 7, 1989 | [JP] | Japan | 1-318335 |

[51] Int. Cl.[5] ..... G09G 3/36

[52] U.S. Cl. ..... 340/784; 340/805

[58] Field of Search ..... 340/784, 765, 805; 359/55

[56] References Cited

U.S. PATENT DOCUMENTS

| | | | |
|---|---|---|---|
| 3,995,942 | 12/1976 | Kawakami et al. | 340/784 |
| 4,485,380 | 11/1984 | Soneda et al. | 340/784 |
| 4,845,482 | 7/1989 | Howard et al. | 340/805 |
| 4,864,290 | 9/1989 | Waters | 340/784 |
| 5,010,326 | 4/1991 | Yamazaki et al. | 340/784 |

FOREIGN PATENT DOCUMENTS

| | | |
|---|---|---|
| 303510 | 2/1989 | European Pat. Off. . |
| 374845 | 6/1990 | European Pat. Off. . |
| 384229 | 8/1990 | European Pat. Off. . |
| 60-19195 | 1/1985 | Japan . |
| 60-19196 | 1/1985 | Japan . |
| 62-31825 | 2/1987 | Japan . |
| 63-159914 | 1/1990 | Japan . |

*Primary Examiner*—Jeffery A. Brier
*Attorney, Agent, or Firm*—Blum Kaplan

[57] ABSTRACT

A liquid crystal display device wherein scanning voltages are applied to a plurality of scanning electrodes and signal waveforms are applied to a plurality of signal electrodes. The polarity of the voltages applied to the signal and scanning electrodes is inverted during predetermined periods. As the effective voltage of the display element is changed, correcting voltages are applied to the signal electrodes in order to reduce the contrast problem associated with changes in the effective voltage of adjacent display elements.

9 Claims, 9 Drawing Sheets

LIQUID CRYSTAL DISPLAY DEVICE

CROSS-REFERENCE TO RELATED APPLICATION

This application is a continuation-in-part of U.S. patent application Ser. No. 07/232,750 filed Aug. 18, 1988, currently pending.

BACKGROUND OF THE INVENTION

The present invention relates to a liquid crystal display device and, in particular, to a liquid crystal display device and method of driving the display which reduces the unevenness of the display.

A known method for driving a matrix-type liquid crystal display device is the voltage averaging method. However, since the signal and scanning electrodes have a resistance greater than zero, the liquid crystal layer acts as a dielectric. Therefore the effective voltages applied to the display elements (dots), defined at the intersection of each scanning electrode with a signal electrode, change depending on the characters and image displayed. As a result, unevenness of the display (uneven linear contrast) occurs.

Another driving method, known as the line reverse driving method, has been proposed to overcome the uneven contrast associated with the voltage averaging method. Disclosed in Japanese Patent Laid-Open Publication Nos. 62-31825, 60-19195 and 60-19196, the line reverse driving method involves inverting the polarity of the voltage applied to the liquid crystal panel multiple times during one frame.

The above described line reverse driving method is effective for improving the evenness of display caused by the variation in the optical characteristics of the liquid crystal layer caused by variations in the frequency of the applied voltages, however the unevenness is not completely remedied.

One further method described in Japanese Patent Application No. 63-159914 proposed by the present inventor is a voltage correcting method. While this method reduces unevenness of the display, further experimentation has revealed that utilization of this method still results in unevenness of display as described below.

Experimentation reveals that various causes have been determined to explain the unevenness of the display remaining even after the application of these prior art liquid crystal display driving methods. These causes are as follows, referring to FIGS. 1–4 as examples. FIG. 1 shows the structure of the liquid crystal display 1. Scanning electrodes Y1 to Y6 are arranged on the substrate 2 and signal electrodes X1 to X6 are arranged on the substrate 3. The intersection of a scanning electrode and a signal electrode is defined as a display element (dot) on the matrix display. A voltage is applied to each signal electrode. A lighting voltage is applied to the signal electrode if the corresponding display element is to be in the "ON" position (indicated by cross hatching in the drawings) while a "non-lighting" voltage is applied if the corresponding display element is to be in the "OFF" position. A scanning (selective) voltage is sequentially applied to scanning electrodes Y1–Y6 and then to scanning electrodes Y6–Y1. This scanning voltage is shifted from the first scanning electrode to the next scanning electrode at a predetermined time so that only one line of data is active at one time. As the selective or scanning voltages are applied in a particular order to scanning electrodes Y1 through Y6, lighting or non-lighting voltages are applied simultaneously to signal electrodes X1 through X6. A display element becomes illuminated (darkened) if the corresponding scanning electrode is selected and a lighting voltage is impressed on the corresponding signal electrode. If a non-lighting voltage is impressed on the signal electrode, the intersection of the signal electrode and the selected scanning electrode is a unilluminated display element. The liquid crystal display provides a "positive display". In other words the display element becomes dark, and is therefore displayed, when the effective voltage applied to the display element increases above a threshold. In order to avoid the application of a direct current to the display panel, the polarity of the signal and scanning voltages is reversed every frame. A frame is defined as the period of time it takes for the scanning voltage to be applied to each of scanning electrodes Y1 through Y6. Referring to FIGS. 3 and 4, one frame is indicated by F1 and the next frame of reversed polarity is indicated by F2.

If the resistance of the scanning electrodes Y1 through Y6 were the ideal, zero, a low-pass filter would be formed by the condenser defined by each display element, utilizing the dielectric of the liquid crystal and the resistance of the signal electrodes. Referring specifically to FIG. 2, R represents the resistance of a signal electrode X1–X6 and C represents the condenser formed by the display element. The ground represents the resistance of the signal electrode as being zero. In FIG. 2, damping occurs when the voltage across the condenser changes from positive to negative and from negative to positive relative to the scanning electrode. When this change between positive to negative occurs frequently, the effective voltage between the signal electrode and the scanning electrode becomes smaller. Referring to FIG. 1 for example, larger damping occur when the display elements at signal electrode X2 are changed from illuminated (ON) to nonilluminated (OFF) to illuminated to nonilluminated to illuminated (every other display element ON) when the scanning electrodes are scanned from the upper side (Y1 to Y6), than in the case in which the display elements formed at the signal electrode X4 are changed from nonilluminated (OFF) to illuminated (ON) to illuminated to illuminated to illuminated to nonilluminated when the scanning electrodes are scanned from the upper side (Y1 to Y6).

FIGS. 3 (*a*)–(*c*) and 4 (*a*)–(*c*) illustrate this principle. During the first frame, period F1, the voltages V0, V4, V5 and V3 are the selected, non-selected, lighting and non-lighting voltages respectively. During the second frame, period F2, the voltages V5, V1, V0 and V2 are the selected, non-selected, lighting, and non-lighting voltages respectively. FIG. 3(*a*) shows the voltage waveform of the signal electrode X2 which corresponds to the scanning electrode Y4. FIG. 3(*b*) shows the voltage waveform of the scanning electrode Y4. FIG. 3(*c*) shows the difference between the voltages of the signal electrode X2 and the scanning electrode Y4. Likewise, FIG. 4(*a*) shows the voltage waveform of the signal electrode X4 corresponding to the scanning electrode Y4. FIG. 10(*b*) shows the voltage waveform of the scanning electrode Y4 and FIG. 4(*c*) depicts the difference between the voltage waveforms of signal electrode X4 and the scanning electrode Y4. The hatched portions show the effect of damping on the variation from the ideal waveform.

Comparing FIGS. 3(*c*) and 4(*c*) it is apparent that more damping occurs at signal electrode X2 than at signal electrode X4. Specifically, the display elements on signal electrode X2 in this example are brighter than the dots on signal electrode X4, leading to nonuniformness of the display.

The number of changes in voltage between each signal electrode and the scanning electrode can be made uniform to some extent by using the line reversing driving method. This method can therefore partially alleviate the damping as it attempts to fix the effective voltage across the display elements. However, damping still occurs because the effective voltage cannot be made completely uniform, but rather, depends on the image being displayed.

By this invention, applicant further reduces the unevenness effect produced by the damping.

SUMMARY OF THE INVENTION

Generally speaking, in accordance with the invention, a liquid crystal display having a plurality of display elements which can be illuminated and nonilluminated to produce a pattern to be displayed includes a first substrate and a second substrate spaced apart with liquid crystal material disposed therebetween. The first substrate includes a group of scanning electrodes disposed thereon. The second substrate includes a group of signal electrodes disposed thereon. Driving circuitry applies different voltage levels across at least one of the display elements by periodically applying a voltage to select at least one of the picture elements to be illuminated. The driving circuitry includes scan voltage circuitry for applying selected and non-selected scan waveforms to the scanning electrodes and signal voltage circuitry for applying illuminated and nonilluminated signal waveforms to the signal electrodes.

The driving circuitry applies a correcting lighting or correcting non-lighting voltage to the signal electrode when the voltage changes from lighting to non-lighting or non-lighting to lighting or in the case where the voltage remains the same and the selected voltage changes polarity. The application of the correcting voltages greatly reduces the damping.

Accordingly, it is an object of this invention to provide an improved liquid crystal display device which substantially reduces the unevenness in the contrast of the display.

It is another object of this invention to provide an improved liquid crystal display device which applies correcting voltages to the signal electrodes by comparing the incoming signal data to the data received in the prior period.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

As described above, the unevenness on the display is caused by the damping which results when the voltage on each signal electrode is changed as voltages on the scanning electrodes are changed. In order to cure this problem a correcting lighting voltage and a correcting non-lighting voltage are added to the damped effective voltage by application to the lighting voltage and non-lighting voltage. An example of the liquid crystal display device for carrying out such correction is described below.

Figure 5:
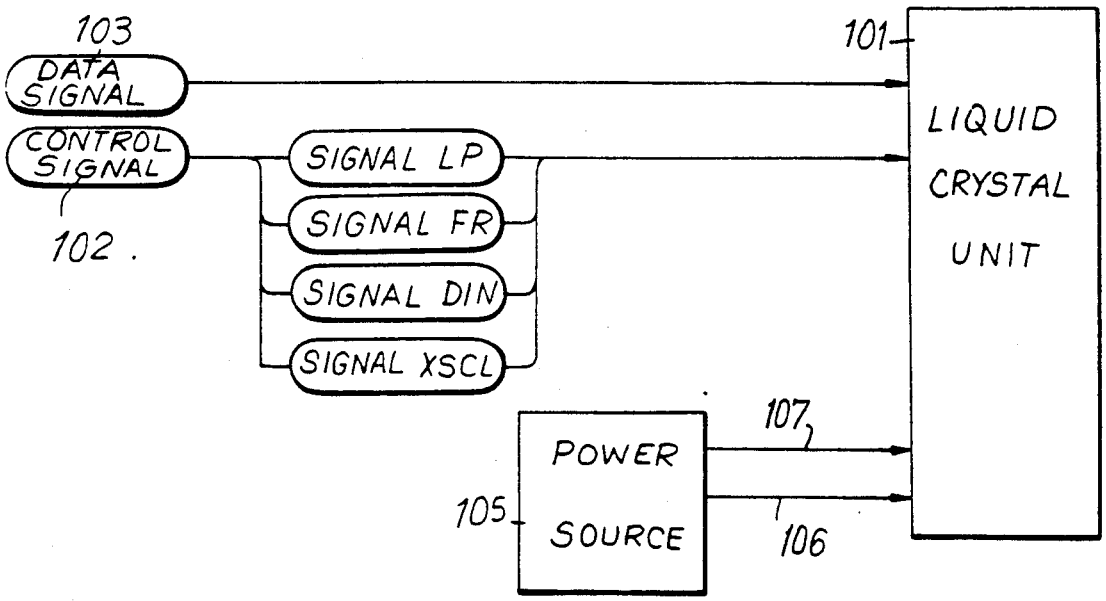
FIG. 5 is a circuit diagram of the circuitry for driving the liquid crystal display in accordance with the invention.

Referring now to FIG. 5, a liquid crystal display driving circuit in accordance with the invention is depicted. A liquid crystal display unit 101 is powered by a power source 105 which splits into two power lines 106, 107 to drive the signal and scanning electrodes. Signal power line 107 drives the signal electrodes (the X power source) while scanning power line 106 drives the scanning electrodes (the Y power source). A series of sequential control signals are produced by control signal circuit 102 for controlling the operation of liquid crystal display device 101 include a latch signal LP, a frame signal FR, a data-in signal DIN and an X driver shift clock signal XSCL. A data signal input 103 applies a data signal for creating a display pattern.

Figure 6:
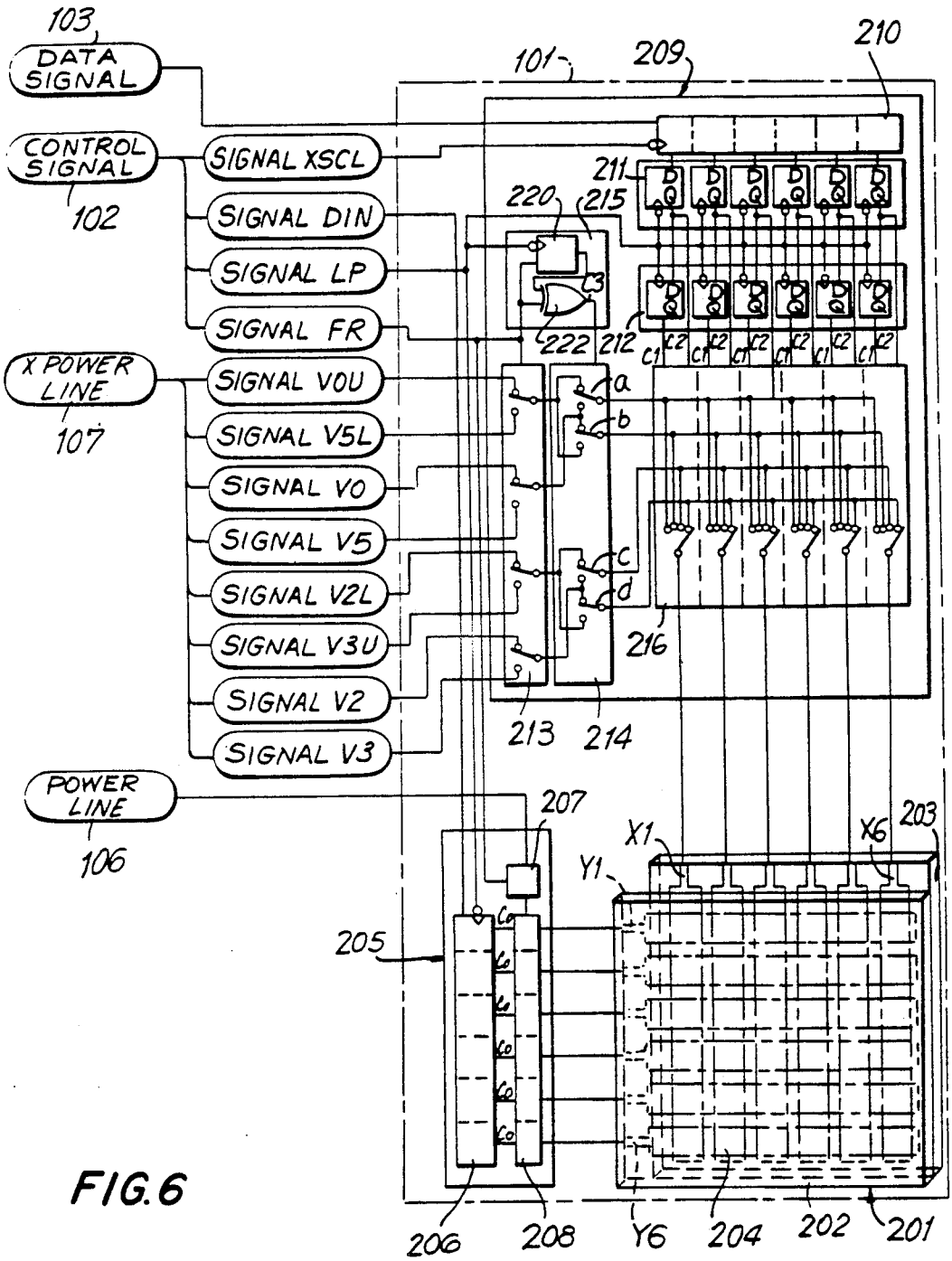
FIG. 6 is a circuit diagram of the liquid crystal unit of FIG. 5 in accordance with the invention.

FIG. 6 illustrates a specific construction of liquid crystal unit 101. The liquid crystal display panel 201 is provided with scanning electrodes Y1 through Y6 arranged on one substrate 202 and signal electrodes X1 through X6 arranged on the other substrate 203. Substrates 202 and 203 sandwich the liquid crystal layer therebetween. Each display element 204 is formed by the intersection of a scanning electrode and a signal electrode. The display device of FIG. 6 is a 6×6 matrix provided with six scanning and six signal electrodes.

This example is provided to simplify matters. In practice this number is usually greater.

The Y driving circuit 205 includes a shift register circuit 206, a switching circuit 207 and a level shifter circuit 208. The six outputs of level shifter circuit 208 are each respectively inputted to a corresponding scanning electrode Y1 through Y6 of liquid crystal display unit 201. Upon each trailing edge of latch signal LP, data-in signal DIN is input to shift register circuit 206, to transfer the data-in signal DIN sequentially into each register of shift register circuit 206. Signal DIN which is active (has a value of "1") when the electric potential is high H"), is outputted once during an interval defined by more than the number of latch signals LP or by the number of scanning electrodes in liquid crystal panel 201. Therefore, the "H" DIN ("1") signal travels sequentially through the stages of shift register circuit 206 while the other stages of shift register 206 are at a low potential ("L") and non-active (a value of "0")). Each stage of shift register 206 outputs its state ("1" or "0") to level shifter circuit 208 as control signals C0.

Switching circuit 207 divides the voltages V0, V1, V4 and V5, which comprise Y power source voltages from scanning power line 107 into a first voltage group V0 and V4 and a second voltage group V1 and V5. Switching circuit 207 utilizes the frame signal FR to choose between the voltage groups. The voltage V0 is the selective voltage of the first group while V4 is the non-selective voltage. Likewise V5 is the selective voltage of the second group and V1 is the non-selective voltage. Switching circuit 207 outputs the first or second voltage group depending on the state of the frame signal FR. When any control signal C0 output of shift register circuit 206 is active "1", the selective voltage (V0 or V5) is supplied to the corresponding scanning electrodes by level shifter circuit 208. When the control signal C0 is "0", the non-selective (V1 or V4) voltage is supplied to the scanning electrode.

The level shifter circuit 208 is provided with a plurality (corresponding to the number of stages of shift register 205 and scanning electrodes Y1–Y6) of switches having two (2) output circuits and one (1) connecting point for receipt of control signal C0. When the control signal C0 output from a stage of shift register 206 is "1", the corresponding switch of the level shifter circuit 208 selects the selective voltage output from the switching circuit 207 and outputs that voltage. When the control signal C0 is "0", each switch of the level shifter circuit 208 selects the non-selective voltage output from the switching circuit 207 and outputs the non-selective voltage.

The operation of Y-driver circuit 205 is as follows. Data-in signal DIN is input to shift register circuit 206 at the trailing edge of each pulse of latch signal LP. Level shifter circuit 208 sequentially outputs the selective voltage to the corresponding scanning electrode of liquid crystal display panel 201. The scanning electrode being driven by the selective voltage is referred to as the selected scanning electrode. The other outputs from level shifter circuit 208 are the non-selective voltage, which is provided to the remaining scanning electrodes.

Again referring to FIG. 6, the X-driving circuit 209 includes a shift register circuit 210, a first latch circuit 211, a second latch circuit 212, a first switching circuit 213, a second switching circuit 214, a detect circuit 25 (for detecting the change of frame signal FR) and a level shifter circuit 216. Each output of level shifter circuit 21 6 is applied respectively to the corresponding signal electrode X1 through X6 of liquid crystal display panel 201. Shift register 210 sequentially receives the data signal from data signal circuit 103 as determined by driver shift clock signal XSCL. Data representing a desired lighting state is referred to as being active (of a value of "1"), while data representative of a desired non-lighting state is referred to as being inactive (of a value of "0"). When the data signal 103 corresponding to each of signal electrodes Xl through X6 is taken into the corresponding stages of shift register 210, the data in the respective shift register stages is transferred to corresponding latch circuits in first latch circuit 211. The data is transferred from shift register circuit 210 to the D inputs of first latch circuit 211 at the trailing edge of the latch signal LP. Once this data is input into first latch circuit 211, the data that was previously in first latch circuit 211 is output from the Q outputs thereof to the D inputs of second latch circuit 212 on the trailing edge of the latch signal LP. Therefore, the present data signal 103 resides in second latch circuit 212 while subsequent data signal 103 resides in first latch circuit 211.

X power source voltages V5L, V5, V3, V3U, V0U, V0, V2 and V2L from scanning power line 107 are divided by first switching circuit 213 into a first voltage group consisting of V5L, V5, V3U and V3 and a second voltage group consisting of V0U, V0, V2 and V2L. The frame signal FR determines which group is chosen depending on the period in which the data is being displayed. In the first group, the voltages V5L, V5, V3 and V3U are defined as the correcting lighting voltage, the lighting voltage, the non-lighting voltage and the correcting non-lighting voltage respectively. Similarly, in the second group, the voltages V0U, V0, V2, V2L are defined as the correcting lighting voltage, the lighting voltage, the non-lighting voltage and the correcting non-lighting voltage respectively.

Detect circuit 215 detects a change in the signal FR in synchronization with latch signal LP. In the present example, this circuit is formed by flip-flop circuit 220 and exclusive—or gate 222. Latch signal LP is applied to the clock input of flip-flop circuit 220 while frame signal FR is input as the D input to the flip-flop circuit and one of the inputs to exclusive—or gate 222. The other input to exclusive—or gate 222 is the Q output of flip-flop circuit 220. The output of the exclusive—or gate is the output C3 of detect circuit 215. When frame signal FR is changed (goes to a high, "1" valve) in synchronization with the latch signal LP, the next latch signal LP outputs a "1" signal C3 from detect circuit 215 which is active "1" until the next latch signal LP is input into flip-flop circuit 220.

The outputs of second switching circuit 214 are defined as a, b, c and d. Second switching circuit 214 selects the proper a,b,c and d values depending on the state of C3. When C3 is "1", the switches are in the positions illustrated in FIG. 6. When C3 is "0" the switches are shifted to the alternate positions.

When the output of detect circuit 215 is active "1", a is the correcting lighting voltage, b is the lighting voltage, c is the correcting non-lighting voltage and d is the non-lighting voltage. When the output of detect circuit 215 is inactive "0", a is the lighting voltage, b is the correcting lighting voltage, c is the non-lighting voltage and d is the correcting non-lighting voltage.

Level shifter circuit 216 takes one of the a,b,c and d outputs from second switching circuit 214, as determined by control signals C1 (from second latch circuit 212) and C2 (from first latch circuit 211). When control signals C1 and C2 are active "1", indicated as (C1, C2)=(1, 1), a is selected. When (C1, C2)=(1,0), b is selected. Likewise, when (C1, C2)=(0,0), c is selected and finally when (C1, C2)=(0,1), d is selected. The selected voltage is supplied to the corresponding signal electrode X1 through X6 of the liquid crystal display panel 201.

X driving circuit 209 takes the data signal from data signal unit 103, which determines the state of display elements 204 formed by the intersection of scanning electrode Yn in an address n (where n=1, 2, . . . 6. unless n-1=6, in which case n=1) and each signal electrode X1 through X6, into shift register circuit 210 during the scanning of scanning electrode Yn-1 in the address of n-1. When all the data signals for scanning electrode Yn are in shift register 210, the data is transferred into first latch circuit 211 by latch signal LP, namely the data corresponding to the display elements along row Yn. The data corresponding to scanning electrode Yn-1 of address n-1 originally in first latch circuit 211 is then transferred to second latch circuit 212.

When control signal C3 is non-active "0", the data of the first latch circuit 211 indicates the lighting and non-lighting state when the scanning electrode Yn-1 is selected. The corrected lighting or corrected non-lighting voltages are substituted when the data corresponding to scanning electrode Yn-1 is different than the data corresponding to scanning electrode Yn. As an example of the normal case, if (C1, C2)=(1,1), the lighting voltage is output. If however (C1, C2)=(0,1), the correcting non-lighting voltage is output.

When the control signal C3 is active "1", in the case where there is a transition from one frame to another as determined by detect circuit 215, the correcting voltages are outputted when C1 and C2 are in the same states, both lighting or non-lighting. Specifically, in the latter case, the corrected lighting or corrected non-lighted voltages are substituted when the data on the last scanning electrode of the frame is the same as the data on the first scanning electrode of the next frame. If they are in different states the correcting voltages are not outputted. As examples, when (C1, C2)=(1,1) (referring to the special case of C3 being active "1"), the output is the correcting lighting voltage. However when (C1, C2)=(0,1) (also in the special case), the output is the non-lighting voltage.

The liquid crystal display unit 101 is synchronized by the data-in and latch signals, DIN and LP, and the scanning voltage is sequentially applied to the scanning electrodes Y1 through Y6 while the selected (as described above) correcting lighting, lighting, correcting non-lighting, or non-lighting voltage is applied to the signal electrodes X1 through X6 to form a display pattern on liquid display panel 201.

Figure 1:
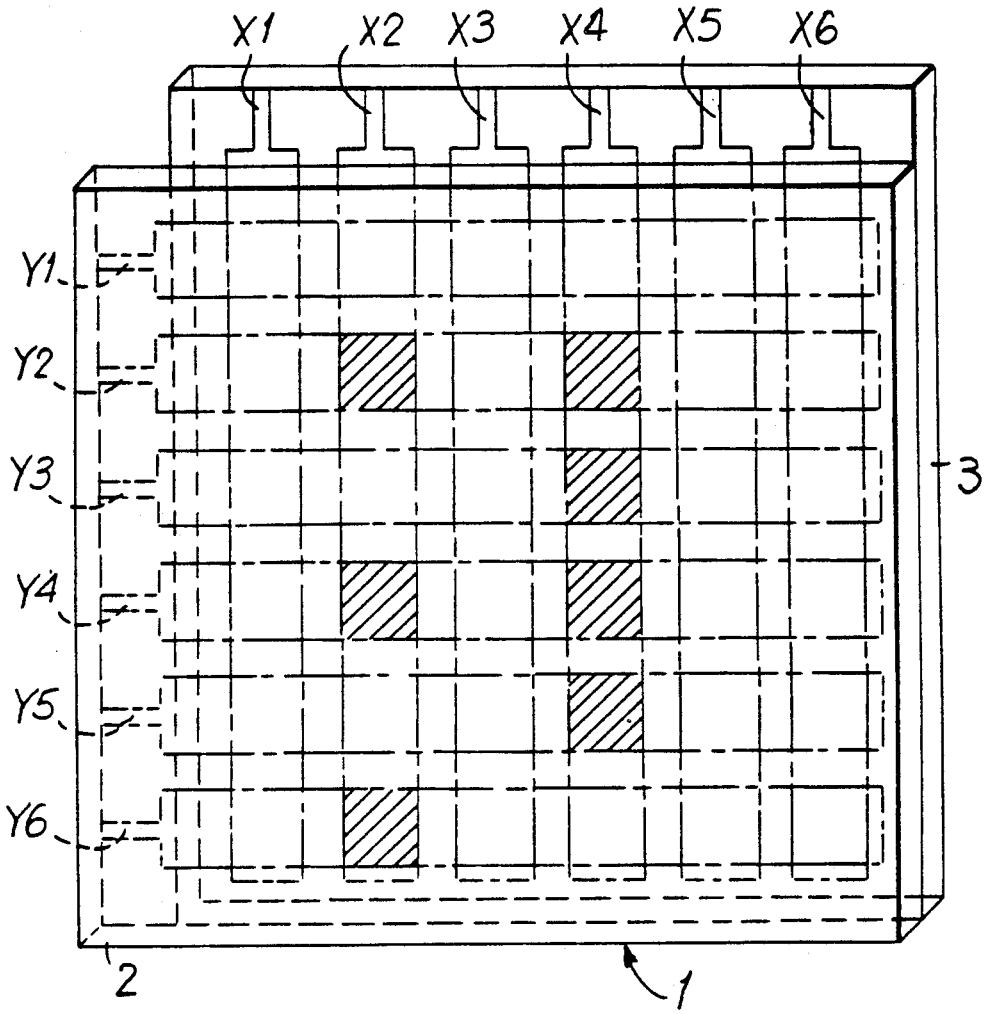
FIG.1 PRIOR ART
FIG. 1 is a perspective view of the liquid crystal display in accordance with the invention illustrating the problems with the prior art.
Figure 2:
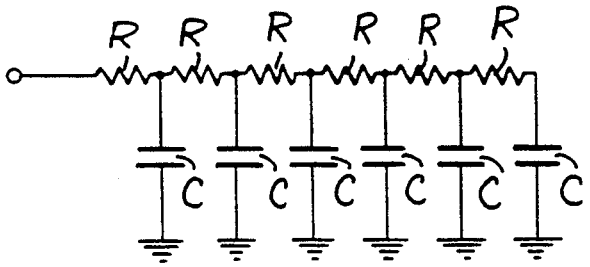
FIG.2 PRIOR ART
FIG. 2 is a schematic showing an electronic model of the liquid crystal display of FIG. 1.
Figure 3A:
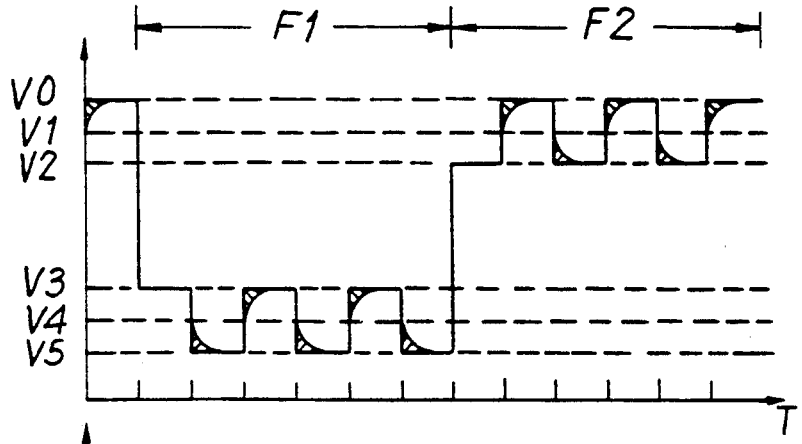
FIG.3(a) PRIOR ART
FIGS. 3(*a*) through 3(*c*) are voltage waveforms of the X2 signal electrode, the Y4 scanning electrode and the difference (X2–Y4) applied to the display in FIG. 1.
Figure 3B:
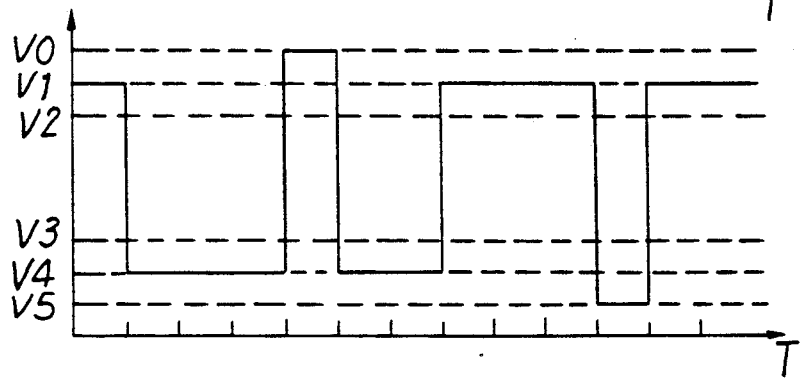
FIG.3(b) PRIOR ART
Figure 3C:
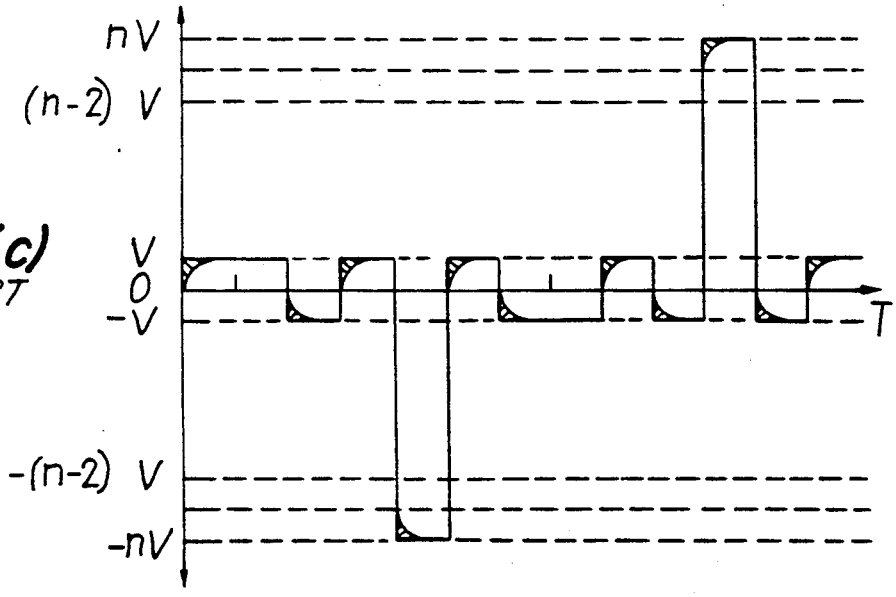
FIG.3(c) PRIOR ART
Figure 4A:
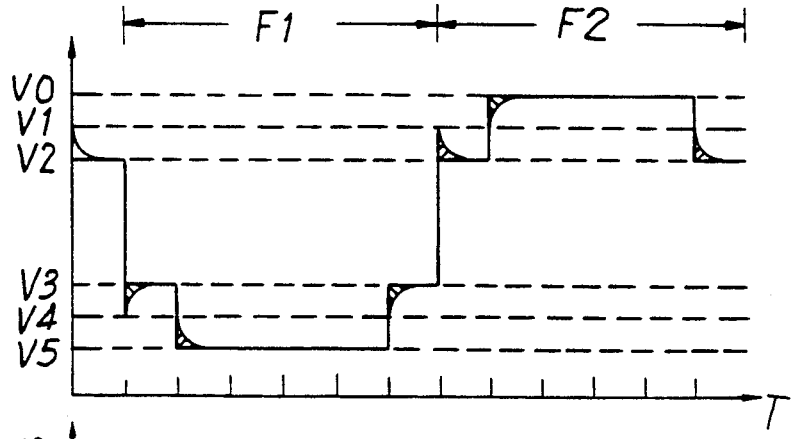
FIG. 4(a) PRIOR ART
FIGS. 4(*a*) through 4(*c*) are voltage waveforms of the X4 signal electrode, the Y4 scanning electrode and the difference (X4–Y4) applied to the display in FIG. 1.
Figure 4B:
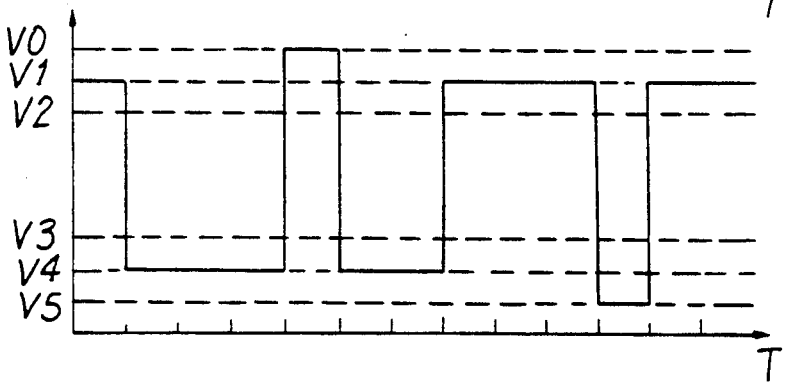
FIG. 4(b) PRIOR ART
Figure 4C:
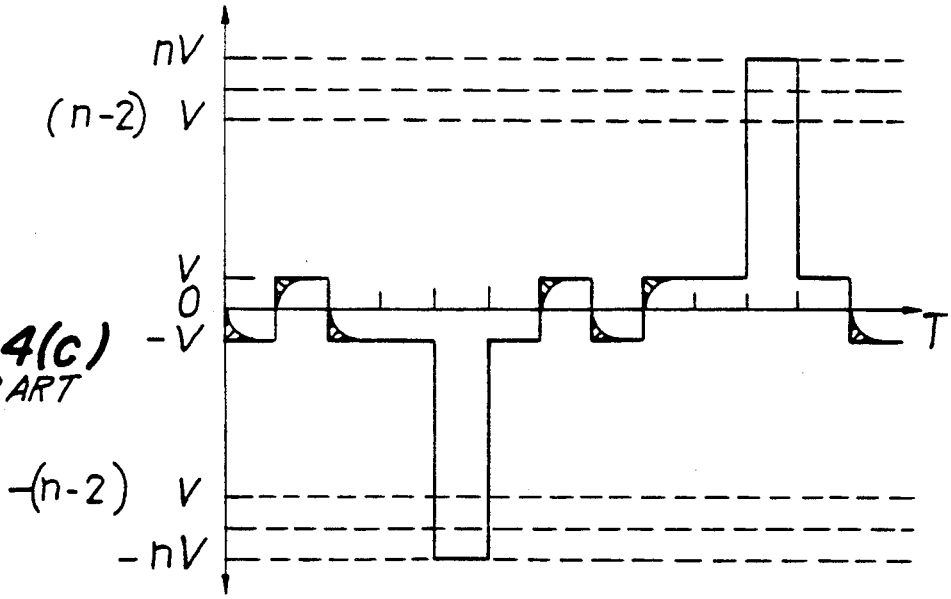
FIG. 4(c) PRIOR ART
Figure 7:
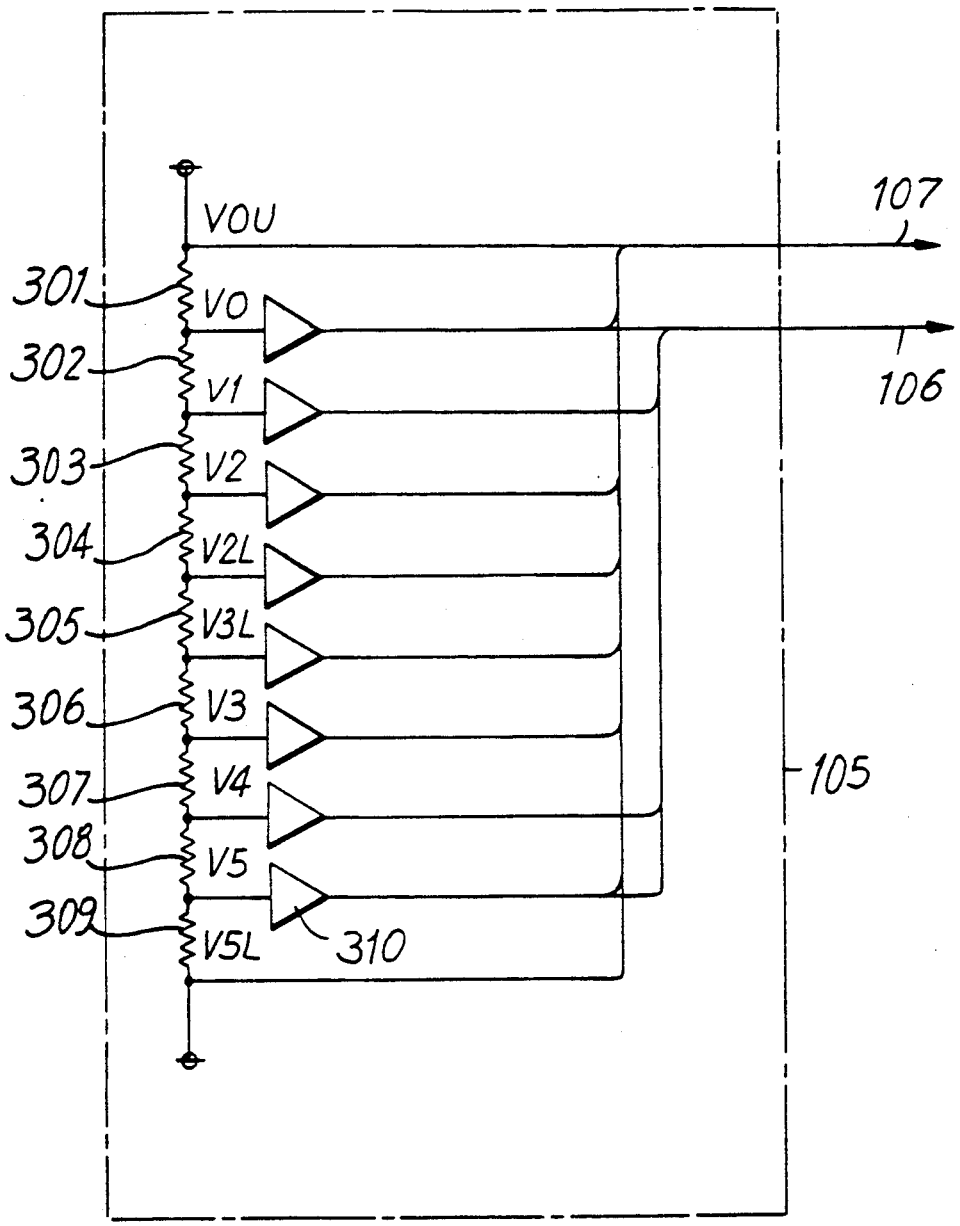
FIG. 7 is a circuit diagram of the power source circuit in accordance with the invention.

FIG. 7 is a circuit diagram of power source 105 of FIG. 1. Resistors 301 through 309 are connected in series, the ends of the series correction being respectively supplied with voltages V0U and V5L. Resistors 301 through 309 act as a voltage dividing circuit. Voltages generated at the respective ends of each resistor 301 to 309 are indicated by V0U, V0, V1, V2, V2L, V3L, V3, V4, V5, and V5L respectively. The relationship between the voltages are as follows:

$$\begin{aligned} V &= V0-V1 \\ &= V1-V2 \\ &= V3-V4 \\ &= V4-V5 \end{aligned}$$

(wherein, $V2-V3=a\cdot V$, where a is the constant value which is in the range of approximately 1 to 50). The resistance of each resistor can be calculated with the following formulas:

$$V0U-V0=V5-V5L=\alpha V$$

$$V2-V2L=V3U-V3=\beta V \text{ (wherein } \alpha \text{and } \beta>1)$$

The voltage stabilizing circuit 310 stabilizes the split voltages across resistors 301 through 309 and decreases the impedance of each voltage. Voltage stabilizing circuit 310 includes a voltage follower circuit based on an arithmetic amplifier circuit and an emitter follower formed from a transistor.

Voltages V0, V1, V4 and V5 are supplied to the liquid crystal display device in FIG. as the Y power source applied to power lines 106, and voltages V0U, V0, V2, V2L, V3U, V3, V5 and V5L are supplied as the X power source applied to power line 107.

Figure 8:
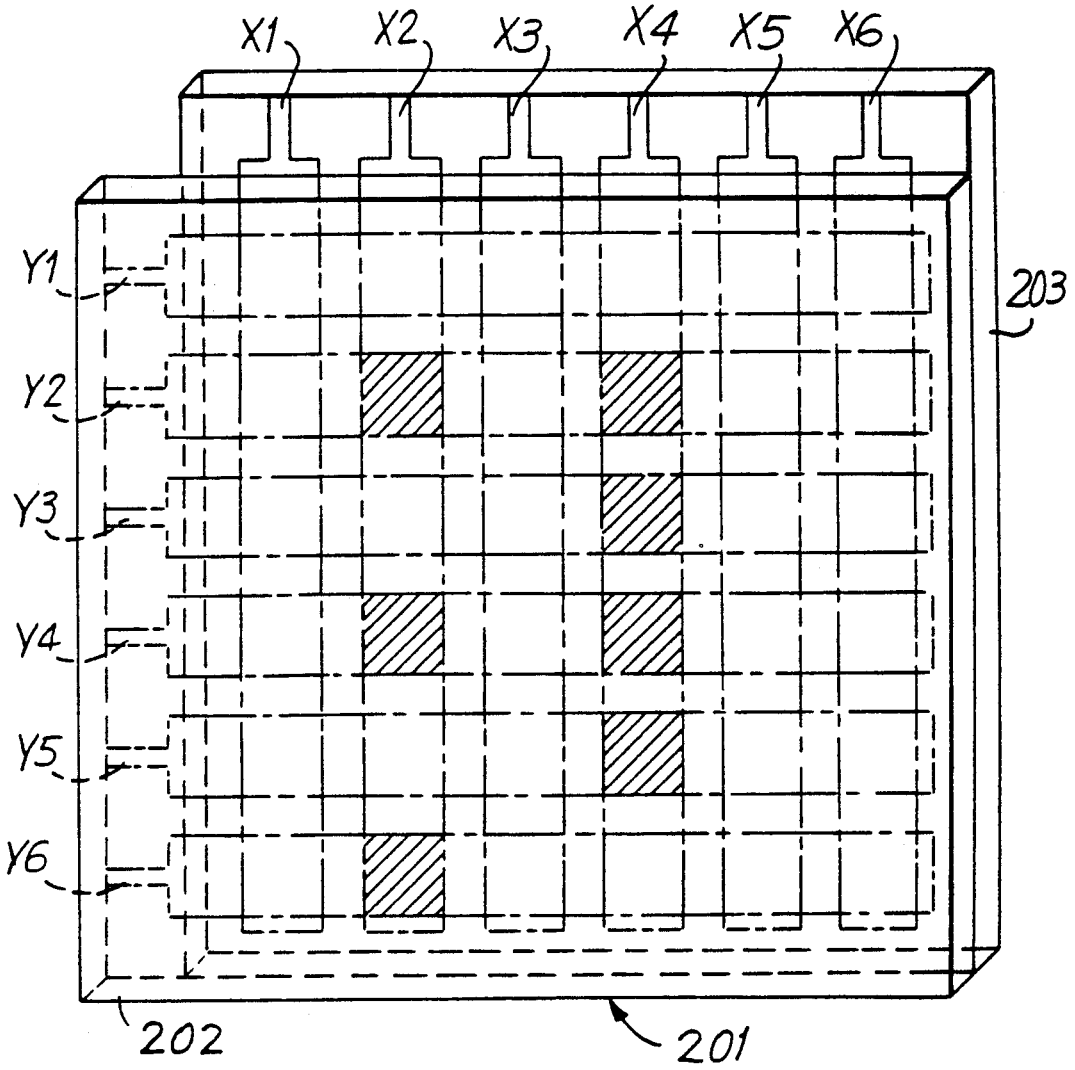
FIG. 8 is a perspective schematic view of the liquid crystal display in accordance with the invention.

Referring specifically to FIG. 8, every other display element on signal electrode X2 is illuminated, the hatching showing illumination. The top and bottom display elements of the X4 electrode are unilluminated while the other four are illuminated. In the present example, after each of the scanning electrodes Y1 through Y6 is selected, the voltages applied to the liquid crystal display panel 201 are changed by reversing the polarity thereof. The second group of voltages is selected by first switching circuit 213 in response to frame signal FR. Frame signal FR changes when scanning electrode Y1 is selected. However, when the polarity is reversed it is not limited to the selection of scanning electrode Y1, the frame signal FR can be synchronized with the latch signal LP at any time.

Figure 9A:
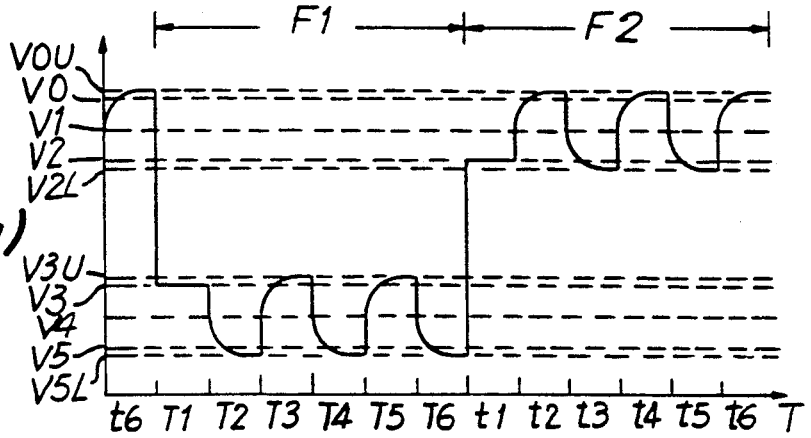
FIGS. 9(*a*) through 9(*c*) are timing charts of the X2 signal electrode, the Y4 scanning electrode and the difference (X2–Y4) applied to the display in FIG. 8.
Figure 9B:
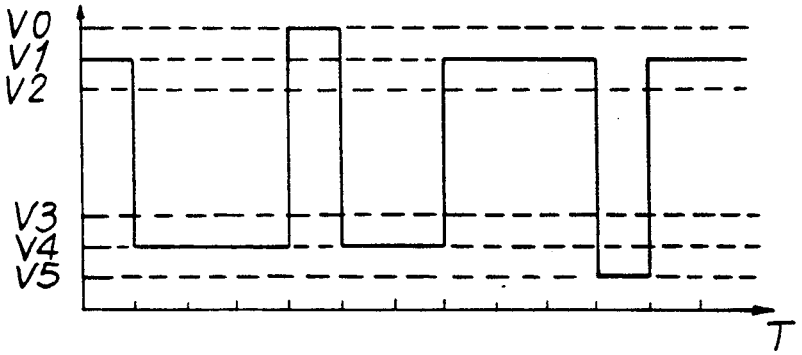
Figure 9C:
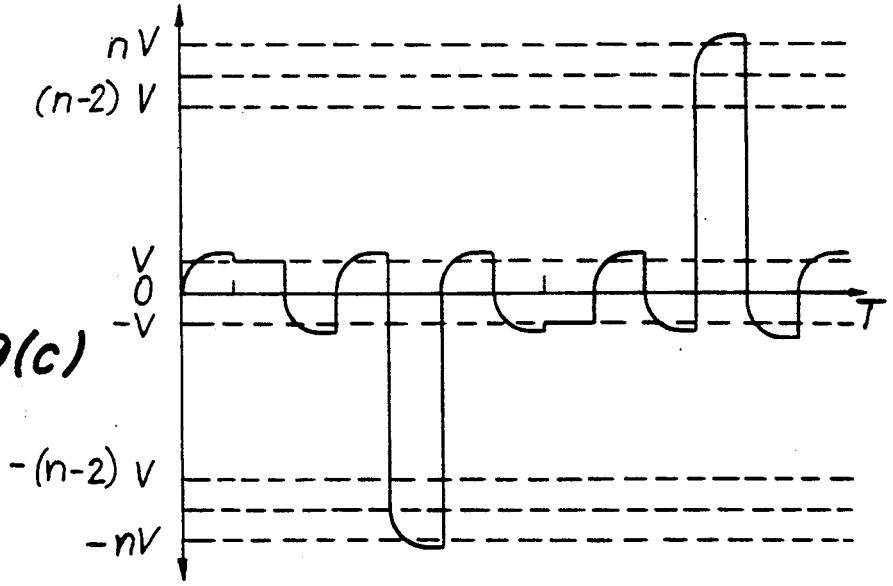

The following examples of the operation of the circuit of FIG. 6 are based on the display of FIG. 8 and corresponding waveforms are shown in FIGS. 9(*a*)-(*c*) and 10(*a*)-(*c*).

In the first example, the data in the first latch circuit 211 and second latch circuit 212 correspond to signal electrode X2. The control signal C3 output from detect circuit 215 changes state after the Y6 scanning electrode is selected. When the scanning electrode Y1 is selected, the output of first latch circuit 211 is C2=0, the output of second latch circuit 212 is C1=1 and the control signal C3 becomes 1. The voltage output from level shifter circuit 216 is the non-lighting voltage. The following data shows the progression a the selected voltage travels from scanning electrode Y1 to scanning electrode Y6. The data will appear in the following form. (C1, C2, C3, Output of level shifter circuit).

When the scanning electrode Y2 is selected, (1, 0, 0, correcting lighting voltage).

When the scanning electrode Y3 is selected, (0, 1, 0, correcting non-lighting voltage).

When the scanning electrode Y4 is selected, (1, 0, 0, correcting lighting voltage).

When the scanning electrode Y5 is selected, (0, 1, 0, correcting non-lighting voltage).

When the scanning electrode Y6 is selected, (1, 0, 0, correcting lighting voltage).

Similarly, when the data corresponding to the X4 signal electrode is inputted into first latch circuit 211 and second latch circuit 212, the control signal C3 and output voltage vary as defined below.

When the scanning electrode Y1 is selected, (0, 0, 1, correcting non-lighting voltage), When the scanning electrode Y2 is selected, (1, 0, 0, correcting lighting voltage), When the scanning electrode Y3 is selected, (1, 1, 0, lighting voltage), When the scanning electrode Y4 is selected, (1, 1, 0, lighting voltage), When the scanning electrode Y5 is selected, (1, 1, 0, lighting voltage), When the scanning electrode Y6 is selected, (0, 1, 0, correcting non-lighting voltage).

Referring specifically to FIGS. 9(*a*) through 9(*c*) (representing the example of signal electrode X2 of FIG. 8) and 10(*a*) through 10(*c*) (representing the example of signal electrode X4 of FIG. 8), the time frame T1 through T6 shows the period in which each scanning electrode Y1 through Y6 is selected by the first group of voltages. The time frame t1 through t6 is the period that each scanning electrode is selected by the second group of voltages. The time frame T1 through T6 represents the first frame and the time frame t1 through t6 represents the second frame. As shown in FIGS. 9(*a*) and (*c*), when the voltage applied to signal electrode X2 is changed from illuminated to non-illuminated, damping is caused during the time period T2 through T6. However, by supplying the correcting lighting voltage and the correcting non-lighting voltage in place of the lighting voltage and the non-lighting voltage when the damping is caused, the decrease of the effective voltage to each element on the signal electrode X2 caused by the damping is decreased because the absolute value of the difference between the correcting lighting voltage and the correcting non-lighting voltage is greater than the absolute value of the difference between the lighting voltage and the non-lighting voltage.

During the periods T1 and t1, the non-lighting voltage is applied because the voltage on the signal electrode X2 changes at the same time that the polarity of the voltages changes to the second group. Frame signal FR is activated causing the second group of voltages to be utilized. Since this occurs at the same time, the effective voltage does not change and damping does not occur.

Figure 10A:
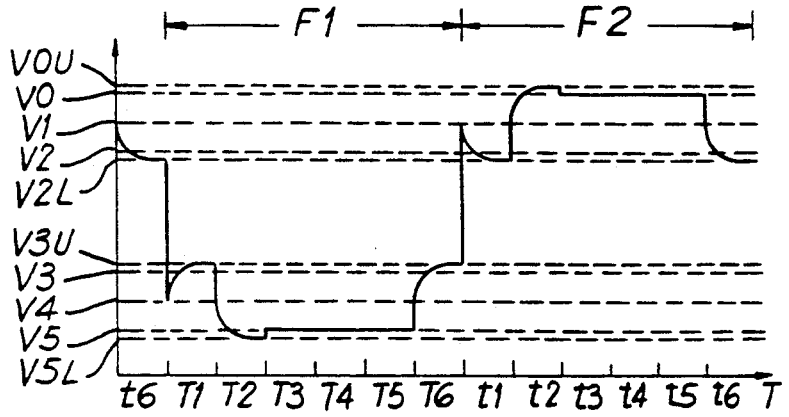
FIGS. 10(*a*) through 10(*c*) are timing charts of the X4 signal electrode, the Y4 scanning electrode and the difference (X4–Y4) applied to the display in FIG. 8.
Figure 10B:
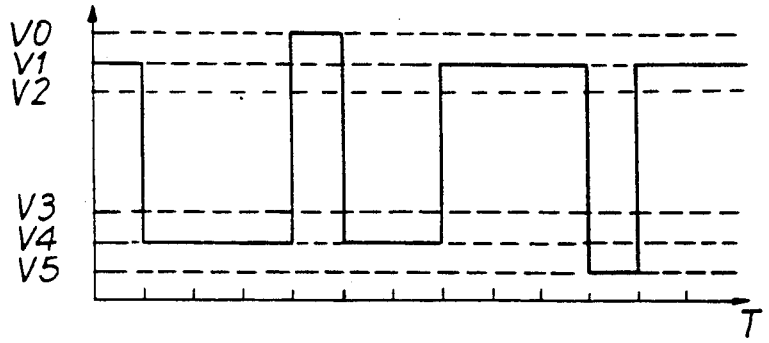
Figure 10C:
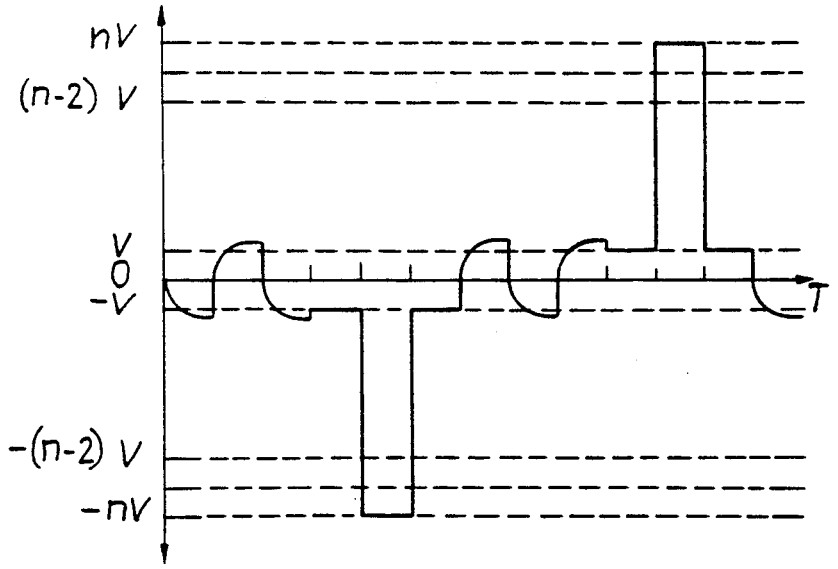

As shown in FIGS. 10(*a*) through (*c*), when the effective voltage to the X4 electrode is unchanged, damping does not occur. Therefore the correcting voltages are not applied. In the periods T1 and t1, the correcting non-lighting voltage is applied because the element is still illuminated when the time frame changes from T6 to t1 and the voltage group changes polarity from the first group to the second. Therefore the effective voltage applied to the signal electrode X4 is changed to cause damping. The amount of damping is decreased by the application of the correcting non-lighting voltage in place of the non-lighting voltage.

As described above, when the effective voltage applied to each signal electrode X1 through X6 is changed, the decrease in the effective voltage applied to the display element is adjusted by applying the correcting lighting voltage and the correcting non-lighting voltage to the signal electrode so that the unevenness of the display can be reduced.

In the present example, the correcting lighting voltage and the correcting non-lighting voltage are defined as constant voltages. However, it is feasible to allow the correcting lighting voltage and the correcting non-lighting voltage to differ from the lighting voltage and the non-lighting voltage during a predetermined period of time being synchronized with the latch signal LP. Furthermore, it is possible to employ any form of the correcting voltage, assuming the damping is caused by the change in the signal voltage from one period to the next. Also, it is possible to vary the absolute value of the difference among the correcting lighting voltage, the correcting non-lighting voltage and the non-correcting voltages in accordance with the environment and temperature. For example, if the material, such as the liquid crystal material, of the liquid crystal panel of the display device is varied by the environment and temperature in which the liquid crystal display device of the present invention is operated, said absolute value of the difference may be varied.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and show in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A liquid crystal display device having a plurality of display elements which can be selectively rendered visible to produce a pattern to be displayed, comprising:
   - a first substrate;
   - a plurality of scanning electrodes disposed on said first substrate;
   - a second substrate spaced apart from said first substrate;
   - a plurality of signal electrodes disposed on said second substrate so that the intersections of said scanning electrodes with said signal electrodes defines said display elements;
   - liquid crystal display material interposed between the substrates;
   - driving means for driving said liquid crystal device by applying selected voltages to said scanning and signal electrodes to selectively render visible desired display elements; and
   - said driving means including means for applying corrected voltages to the signal electrodes in response, at least in part, to whether adjacent picture elements along a signal electrode are or are not rendered visible.

2. The liquid crystal display of claim 1, wherein said corrected voltages are applied to the signal electrodes at least when two adjacent display elements are in different states of visibility.

3. The liquid crystal display device of claim 2, wherein said driving means sequentially applies scanning voltages to the respective scanning electrodes, and data voltages representative of lit and unlit states of display elements to said signal electrodes, said scanning voltages and display voltages being of a first polarity during a first period of operation of the liquid crystal display device and of a second opposite polarity during a second period of operation of the liquid crystal display device, said means for applying corrected voltages applying said corrected voltages further applying said corrected voltages at least when the display elements defining a transition from said first period to said second period are of the same visibility state.

4. A liquid crystal display device having a plurality of display elements which can be selectively rendered visible to produce a pattern to be displayed, comprising:

a first substrate;

a plurality of scanning electrodes disposed on said first substrate;

a second substrate spaced apart from said first substrate;

a plurality of signal electrodes disposed on said second substrate so that the intersections of said scanning electrodes with said signal electrodes defines said display elements;

liquid crystal display material interposed between the substrates;

driving means for driving said liquid crystal device by applying selected voltages to said scanning and signal electrodes to selectively render visible desired display elements;

said driving means including means for applying corrected voltages to the signal electrodes in response, at least in part, to whether adjacent picture elements along a signal electrode are or are not rendered visible;

said corrected voltages being applied to the signal electrodes at least when two adjacent display elements are in different states of visibility;

the means for applying corrected voltages including a first register means for storing data representative of the visibility state of at least a portion of the display elements along the scanning electrode to be driven, a second register means for storing a corresponding portion of the data representative of the visibility state of the display elements along the next scanning electrode to be driven and means for determining whether the voltages to be applied to the signal electrodes during the driving of the next scanning electrode should be corrected in response to comparing the contents of corresponding portions of said first and second register means.

5. A liquid crystal display device having a plurality of display elements which can be selectively rendered visible to produce a pattern to be displayed, comprising:

a first substrate;

a plurality of scanning electrodes disposed on said first substrate;

a second substrate spaced apart from said first substrate;

a plurality of signal electrodes disposed on said second substrate so that the intersections of said scanning electrodes with said signal electrodes defines said display elements;

liquid crystal display material interposed between the substrates;

driving means for driving said liquid crystal device by applying selected voltages to said scanning and signal electrodes to selectively render visible desired display elements;

said driving means including means for applying corrected voltages to the signal electrodes in response, at least in part, to whether adjacent picture elements along a signal electrode are or are not rendered visible;

said corrected voltages being applied to the signal electrodes at least when two adjacent display elements are in different states of visibility;

the means for applying corrected voltages including a first register means for storing data representative of the visibility state of at least a portion of the display elements along the scanning electrode to be driven, a second register means for storing a corresponding portion of the data representation of the visibility state of the display elements along the next scanning electrode to be driven, and means for determining whether the voltages to be applied to the signal electrodes during the driving of the next scanning electrode should be corrected in response to comparing the contents of corresponding portions of said first and second register means; and said driving means sequentially applying scanning voltages to the respective scanning electrodes, and data voltages representative of lit and unlit states of display elements to said signal electrodes, said scanning voltages and display voltages being of a first polarity during a first period of operation of the liquid crystal display device and of a second opposite polarity during a second period of operation of the liquid crystal display device, said means for applying corrected voltages further applying said corrected voltages at least when the display elements defining a transition from said first period to said second period are of the same visibility state.

6. A liquid crystal display device having a plurality of display elements which can be selectively rendered visible to produce a pattern to be displayed, comprising:

a first substrate;

a plurality of scanning electrodes disposed on said first substrate;

a second substrate spaced apart from said first substrate;

a plurality of signal electrodes disposed on said second substrate so that the intersections of said scanning electrodes with said signal electrodes defines said display elements;

liquid crystal display material interposed between the substrates;

driving means for driving said liquid crystal device by applying selected voltages to said scanning and signal electrodes to selectively render visible desired display elements;

said driving means including means for applying corrected voltages to the signal electrodes in response, at least in part, to whether adjacent picture elements along a signal electrode are or are not rendered visible;

said corrected voltages being applied to the signal electrodes at least when two adjacent display elements are in different states of visibility;

the means for applying corrected voltages including a first register means for storing data representative of the visibility state of at least a portion of the display elements along the scanning electrode to be driven, a second register means for storing a corresponding portion of the data representation of the visibility state of the display elements along the next scanning electrode to be driven, and means for determining whether the voltages to be applied to the signal electrodes during the driving of the next scanning electrode should be corrected in response to comparing the contents of corresponding portions of said first and second register means;

said driving means for sequentially applying scanning voltages to the respective scanning electrodes, and data voltages representative of lit and unlit states of display elements to said signal electrodes, said scanning voltages and display voltages being of a first polarity during a first period of operation of the liquid crystal display device and of a second opposite polarity during a second period of operation of the liquid crystal display device; and detecting means for detecting transition from said first period to said second period in response to the comparison between the contents of the first and second register means;

said means for applying corrected voltages further applying said corrected voltages to the signal electrodes in response to said detecting means output at least when the display elements defining a transition from said first period to said second period are of the same visibility state.

7. A method for driving a liquid crystal display device having groups of signal and scanning electrodes disposed on a pair opposed of substrates, display elements which can be selectively rendered visible being formed at the intersection of each pair of signal and scanning electrodes, comprising:

correcting the voltages applied to the signal electrodes at least in part in response to whether or not two adjacent data elements along a signal electrode are in different visibility states.

8. The method of claim 7, and including the step of driving the display during successive periods with voltages of opposite polarity, and correcting the voltages applied to the signal electrodes when adjacent display elements along the signal electrodes at the transition between said periods are of the same visibility.

9. The method of claim 7, and including the step of storing the data representative of visibility state of the display elements along successive scanning electrodes and determining whether to apply a corrected or uncorrected voltage to the signal electrodes when the second of the successive scanning electrodes are energized based on a comparison of the data representative of the visibility state of adjacent display elements along the signal electrodes.

* * * * *